US011885254B2

(12) United States Patent
Oguz

(10) Patent No.: US 11,885,254 B2
(45) Date of Patent: Jan. 30, 2024

(54) METHOD AND CONTROL DEVICE FOR CONTROLLING A VEHICLE DEVICE

(71) Applicant: ZF Friedrichshafen AG, Friedrichshafen (DE)

(72) Inventor: Alexander Oguz, Markdorf (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 17/815,299

(22) Filed: Jul. 27, 2022

(65) Prior Publication Data

US 2023/0052200 A1 Feb. 16, 2023

(30) Foreign Application Priority Data

Aug. 16, 2021 (DE) ..... 10 2021 208 943.7

(51) Int. Cl.
*F01P 11/16* (2006.01)

(52) U.S. Cl.
CPC ..... *F01P 11/16* (2013.01); *F01P 2025/50* (2013.01); *F01P 2031/20* (2013.01)

(58) Field of Classification Search
CPC ..... F01P 11/16
See application file for complete search history.

(56) References Cited

U.S. PATENT DOCUMENTS

2004/0015288 A1* 1/2004 Wolber ..... F02D 41/065 701/113
2013/0030623 A1* 1/2013 Thiamtong ..... B60W 20/10 903/903
2017/0361698 A1* 12/2017 Hussain ..... F01P 5/06
2020/0176832 A1* 6/2020 Roemersperger ..... G01N 25/00
2021/0309074 A1* 10/2021 Mizuno ..... B60H 1/00742

FOREIGN PATENT DOCUMENTS

DE 103 06 896 A1 8/2004
DE 10 2013 008 743.0 B3 5/2013
DE 10 2019 004 070.8 A1 10/2020
WO 2004/074704 A1 9/2004

OTHER PUBLICATIONS

German Patent Office, Office Action issued in German patent application No. 10 2021 208 943.7 (dated May 11, 2022).

* cited by examiner

*Primary Examiner* — Long T Tran
(74) *Attorney, Agent, or Firm* — Finch & Maloney PLLC

(57) ABSTRACT

A method for controlling a vehicle device (10) configured to cool of a vehicle unit (20) includes reading in temperature information which is functionally related to an operation of the vehicle unit (20) and determining a temperature gradient. The method also includes checking whether the information read in exceeds a threshold value for the information read in, checking whether the temperature gradient determined exceeds a threshold value, and emitting a signal for the control of the vehicle device (10) as a function of check results of the checking steps, in order to bring about the cooling of the vehicle unit (20) by the vehicle device (10). In addition, a control unit (100) for carrying out the method and a vehicle (200) with a control unit (100) of that type.

11 Claims, 3 Drawing Sheets

METHOD AND CONTROL DEVICE FOR CONTROLLING A VEHICLE DEVICE

RELATED APPLICATIONS

This application claims the benefit of and right of priority under 35 U.S.C. § 119 to German Patent Application no. 10 2021 208 943.7, filed on Aug. 16, 2021, the contents of which are incorporated herein by reference in its entirety.

TECHNICAL FIELD

The invention relates to a method and a control unit for controlling a vehicle device. The invention also relates to a vehicle with a control unit of that type.

BACKGROUND

It is known to cool vehicle components if they exceed a temperature which is critical for the operation of the vehicle components. From DE 103 06 896 A1 a method for controlling the operation of a clutch of a motor vehicle is known. In this method the temperature of a coolant emerging from the clutch is measured. On that basis, a driving characteristic for controlling the clutch is selected.

SUMMARY

One aspect of the present invention relates to a method for controlling a vehicle device in order to bring about the cooling of a vehicle unit. The vehicle device can be a cooling device for bringing about the cooling of the vehicle unit. Thus, the vehicle device can be designed to cool the vehicle unit actively or directly. The vehicle device can also be a vehicle drive device, which can be part of a vehicle drivetrain. Thus, the vehicle device can be designed for the passive or indirect cooling of the vehicle unit. In general terms, cooling is understood to mean a reduction or maintenance of a temperature.

As one step the method comprises the reading-in of information about a temperature which is functionally related to an operation of the vehicle unit. The vehicle unit can comprise at least one vehicle component, which can heat up during the operation of the vehicle and is cooled in order to ensure its proper operation. The information read in can comprise temperature measurement data from a temperature sensor for determining the temperature. The temperature sensor can be a vehicle temperature sensor, which can be comprised in the vehicle unit. As a further step, therefore, the method can comprise the capture of the information by the temperature sensor. Furthermore, the temperature sensor can be arranged or integrated in the vehicle unit. Alternatively, or in addition to the temperature measurement data, the information read in can comprise model data of a temperature model for the temperature. The temperature model can depict the temperature sensor. Thus, as a further step the method can comprise a model-based determination of the information. The information can be read out from the temperature sensor or the temperature model.

The temperature can be a temperature of the vehicle unit or of another vehicle component, which can be functionally connected with the vehicle unit. For example, the temperature can be a fluid temperature of a fluid flowing through, around or onto the vehicle unit. The fluid can be a coolant. Moreover, in general the said functional connection can be one between the operation of the vehicle unit and the temperature, which gives rise to a temperature increase.

Accordingly, the temperature can be a vehicle-unit-related external temperature or an internal temperature.

As a further step, the method comprises the determination of a temperature gradient on the basis of the information read in. The temperature gradient can picture a temperature increase. From the information read in a time variation of the temperature can be derived, from which the temperature gradient can be determined. Thus, the temperature gradient can be determined from a derivative of a temperature variation against time.

As a further step the method comprises a check of whether the temperature gradient determined exceeds a threshold value for the temperature gradient. The said threshold value can be a predetermined one or a threshold value adapted to the operation of the vehicle unit and determined during operation. Thus, the method can comprise as a further step a corresponding step of determining the threshold value for the temperature gradient. Accordingly, in the checking step it can be checked whether a temperature increase exceeds a threshold value for the increase of temperature. A check result established in the checking step can be that the temperature gradient determined does exceed the temperature gradient threshold value. Another check result established in the checking step can be that the temperature gradient determined does not exceed the temperature gradient threshold value.

As a further step, the method comprises the emission of a signal for controlling the vehicle device as a function of a check result of the checking step, in order to bring about the cooling of the vehicle unit by the vehicle device. The vehicle device can be designed to cool the vehicle unit. The signal can comprise a cooling request, which is emitted in order to request or set in hand a cooling measure that can be carried out by the vehicle device. The cooling measure can for example comprise one of the following: activation of a cooling measure, increasing a cooling volume in a cooling flow or coolant, and reducing the cooling temperature of the coolant. Thus, the signal can be emitted in order to request a protective measure that can be carried out by the vehicle device, which measure protects the vehicle unit against overheating in which a threshold which is critical for the proper operation of the vehicle unit is exceeded. If the signal contains the cooling request, this can also be set as a function of, for example proportionally to, the temperature gradient determined, in order to control the vehicle device appropriately.

By virtue of the method, a vehicle unit can be cooled in good time as a function of a current temperature gradient that is functionally related to the operation of the vehicle unit. Thus, the cooling required for the operation of the vehicle unit can be carried out with the method in advance, independently of exceeding a temperature value that is critical for the operation of the vehicle unit. The step of signal emission for controlling the vehicle device can therefore be carried out in anticipation or proactively relative to a potential exceeding of the critical temperature value, in order to prospectively prevent the critical temperature value from being exceeded. Thus, thermal overloading of the vehicle unit can in this way be reduced, and on that basis, advantageously, the lifetime of the vehicle unit can be extended. Furthermore, with the method a ready-to-operate condition of the vehicle unit can be maintained for longer and operation interruptions or damage due to overheating of the vehicle unit can be avoided.

According to an embodiment of the method, as a further step the method can comprise checking whether the information that has been read in exceeds a threshold value for the information that has been read in. The step of checking the read-in information can be carried out before the step of checking the temperature gradient determined. Thus, the method can be carried out on the basis of two different threshold values. The step of checking the temperature gradient determined can be carried out as a function of whether the information read in exceeds the threshold value for that information. The step of checking the temperature gradient determined can therefore be carried out only if the information read in has exceeded the threshold value for that information. The step of checking whether the information read in exceeds a threshold value for that information can therefore consist of a preliminary check which precedes the further step of checking whether the temperature gradient determined exceeds the threshold value for the temperature gradient. Moreover, the signal emission step can be carried out as a function of a check result of the checking step. Thus, the signal can be emitted only if the read-in information and the temperature gradient exceed their respective threshold values. Accordingly, the signal can be emitted first as a function of an absolute information datum such as the temperature of the vehicle unit, and in addition to the said absolute datum as a function of time-related information, for example the temperature gradient.

In a further embodiment of the method, in the signal emission step the signal for controlling the vehicle device can be emitted in order to keep a temperature of the vehicle unit below a critical value for the temperature of the vehicle unit. Thus, the steps of the method can be carried out in advance when the temperature of the vehicle unit is still below the critical temperature value. The temperature of the vehicle unit can be adjusted to a target value which is lower than the critical temperature value. The target value can be predetermined or adapted to the operation of the vehicle unit. Thus, by virtue of the method it can be reliably ensured that the critical temperature value is not exceeded.

If the critical temperature value is reached, it may be necessary to terminate the operation of the vehicle unit as a safety precaution against overheating or fire. When the critical temperature value is reached, the vehicle unit can put itself out of operation by means of an internal protection device in order to avoid overheating or fire. Such a termination of the operation of the vehicle unit can at least have an adverse effect on or can preclude the operation of a vehicle. However, with the invention such drawbacks can be avoided.

According to a further embodiment of the method, in at least one of the checking steps a respective exceeding of at least two staged threshold values is checked in stages. Exceeding of the at least two staged threshold values can be checked in stages by corresponding sub-stages of at least one step of the checking process. According to this embodiment, in the signal emission step the signal can be emitted as a function of a currently exceeded staged threshold value. The signal can comprise the cooling request, which can be matched to suit the currently exceeded staged threshold value. A required cooling request can therefore be adapted efficiently to a current temperature of the vehicle unit.

In a further embodiment of the method, the vehicle device can comprise a cooling device for cooling the vehicle unit. The said cooling device can be one for the active or passive cooling of the vehicle unit. The cooling device can be functionally connected with the vehicle unit by way of a cooling medium or cooling circuit. The vehicle unit can be cooled by the cooling medium or the cooling circuit. The cooling circuit can contain the fluid. In this embodiment, in the signal emission step the signal is emitted in order to control the cooling device so as to bring about the cooling of the vehicle unit by means of the cooling device. On the basis of the signal, the cooling device can be controlled to cool the vehicle unit directly.

According to a further embodiment of the method, the vehicle device can comprise a vehicle drive mechanism. The vehicle device can be a component of a vehicle drivetrain, such as a vehicle motor. The signal emitted can for example comprise a control command for limiting a rotation speed or limiting a torque. In this embodiment, in the signal emission step the signal for controlling the vehicle drive mechanism can be emitted in order to bring about the cooling of the vehicle unit by the vehicle drive mechanism. The vehicle unit can be driven or controlled by the vehicle drive mechanism. Thus, the operation of the vehicle unit can be controlled by means of the vehicle drive mechanism by way of the signal, and the cooling of the vehicle unit can be brought about by the signal emitted. For example, a load can be reduced by the driving or control of the vehicle unit by means of the vehicle drive mechanism, so cooling can also be brought about indirectly.

According to a further embodiment of the method, the vehicle unit can comprise at least one vehicle component of a vehicle drivetrain. The said vehicle component can for example be a vehicle transmission. In the signal emission step, therefore, the signal can be emitted in order to bring about cooling of the transmission by the vehicle device. The transmission can for example be a dual-clutch transmission or a hybrid transmission. Accordingly, the temperature can for example be a temperature of a coolant of the transmission, such as a transmission oil temperature.

In a further embodiment of the method the vehicle unit can comprise at least one vehicle component of a vehicle energy source. The vehicle energy source can be an energy accumulator or an energy converter. The energy accumulator can for example be a vehicle battery or a vehicle battery system. The energy converter can for example be a vehicle fuel cell. Thus, in the signal emission step the signal can be emitted in order to bring about cooling of the energy source. Accordingly, the method can be carried out, for example, with recuperation for charging the energy accumulator. The life of the energy accumulator can in that way be extended advantageously since, for example during recuperation with the method, exceeding a temperature critical for the energy accumulator can be avoided.

According to further embodiments of the method, the vehicle unit can comprise at least one of: a control device, a chip, a processor, a circuit-board and an electronic system such as power electronics. In other embodiments of the method the vehicle unit can comprise at least one of a battery management system and a transmission control unit. In other embodiments of the method the vehicle unit can comprise at least one of a machine, for example an electric machine; a motor, for example an internal combustion engine or an electric motor; a converter, for example a torque converter; a clutch; and a machine axle. In a further embodiment of the method, the vehicle unit can comprise a vehicle cable.

According to a further embodiment of the method, as a further step the method can comprise filtering of the temperature gradients determined. The filtering can include smoothing of the temperature gradients determined. In this embodiment the checking step can be carried out on the basis of the filtered temperature gradients. The signal for controlling the vehicle device can therefore be emitted more reliably. In further embodiments of the method a signal to revoke the cooling request can be emitted on the basis of a hysteresis threshold or after the lapse of a predetermined time interval, in order to terminate the cooling of the vehicle unit by the vehicle device.

In a further aspect, the invention relates to a control unit for the control of a vehicle device for bringing about the cooling of a vehicle unit. The control unit can be designed to carry out the method in accordance with the preceding aspect.

The control unit comprises an interface for reading-in information about a temperature that is functionally related to an operation of the vehicle components. The control unit also comprises a computing system which is designed to determine a temperature gradient on the basis of the information read in. The computing system can also be designed to check whether the information read in exceeds a threshold value for the said information. The computing system is designed to check whether the temperature gradient determined exceeds a threshold value of the temperature gradient. The control unit has an interface for the emission of a signal for controlling the vehicle device as a function of a check result of the checking process, in order to bring about the cooling of the vehicle unit.

A further aspect of the invention is a vehicle comprising a vehicle device for bringing about the cooling of a vehicle unit. The vehicle comprises a control unit for controlling the vehicle device in accordance with the preceding aspect. The vehicle can be a non-rail-bound vehicle such as a motor vehicle or a utility vehicle. Moreover, the vehicle can also be a self-propelling working machine. The vehicle can also be a rail-bound vehicle, an aircraft, a space vehicle or a watercraft.

Within the scope of the invention embodiments and features of one aspect of the invention can be regarded as corresponding embodiments and features of another aspect of the invention.

DETAILED DESCRIPTION OF EMBODIMENTS

Figure 1:
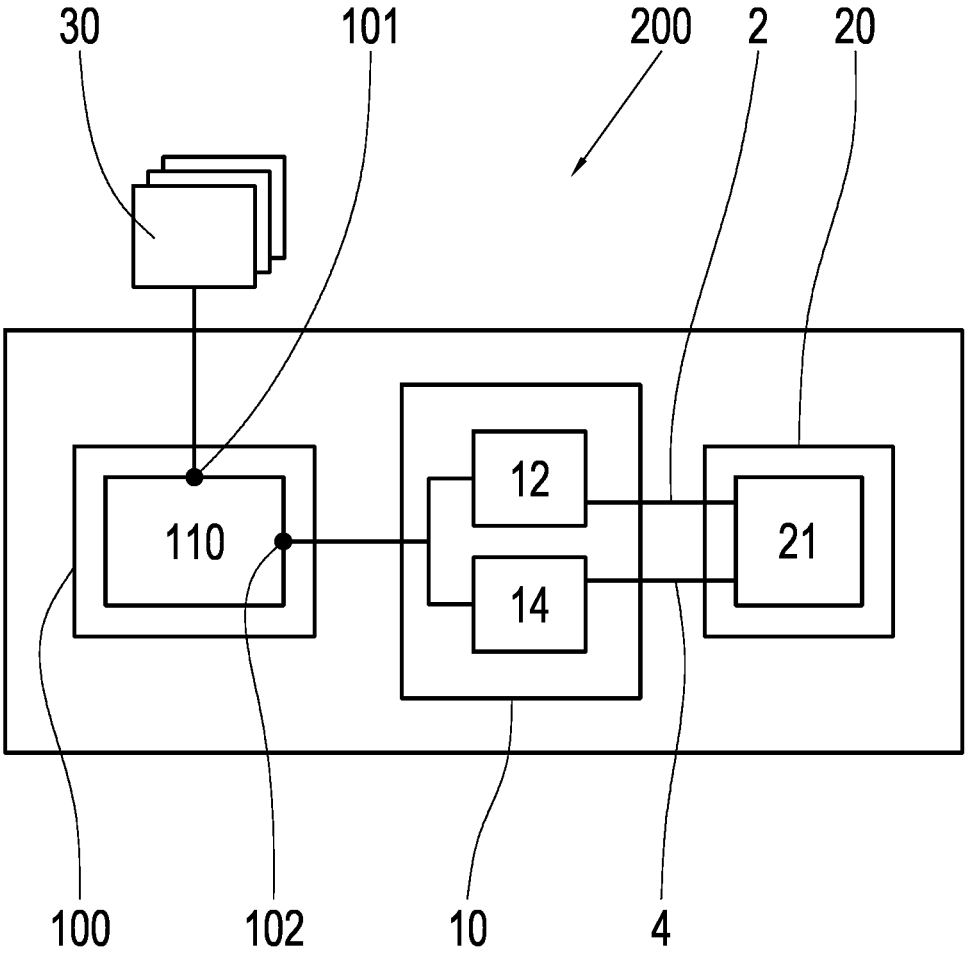
FIG. 1: shows schematically a control unit for controlling a vehicle device and a vehicle according to a particular embodiment of the invention.

FIG. 1 shows schematically a vehicle 200. The vehicle 200 comprises a control unit 100 and a vehicle device 10. The control unit 100 is designed to control the vehicle device 10. In an embodiment, the vehicle device 10 comprises a cooling device 12. Alternatively, or in addition to the cooling device 12, in another embodiment the vehicle 10 comprises a vehicle drive mechanism 14. The vehicle 200 also comprises a vehicle unit 20 which has at least one vehicle component 21. The vehicle device 10 can be controlled by the control unit 100 and is designed to bring about the cooling of a vehicle unit 20. In an embodiment, as a vehicle component 21 the vehicle unit 20 comprises a vehicle transmission in a drivetrain of the vehicle 200 (not shown in the figures). In another embodiment, as a vehicle component 21 the vehicle unit 20 comprises an energy source, for example a battery in the drivetrain of the vehicle 200.

The vehicle device 10, with the vehicle unit 20, is connected to a cooling system 2 in order to bring about cooling of the vehicle unit 20 directly. In an embodiment the cooling system 2 has a coolant flow for cooling the vehicle unit 20, which contains a coolant for cooling the vehicle unit 20. The cooling device 12 actuates the cooling system 2 for cooling the vehicle unit 20. Alternatively, or in addition to the cooling system 2, the vehicle device 10 is connected with the vehicle unit 20 by way of a functional relationship 4 in order to bring about cooling of the vehicle unit 20 indirectly. According to an embodiment the functional relationship 4 involves an energy flow for supplying the vehicle unit 20 with energy. The vehicle drive mechanism 14 provides the energy which is transferred to the vehicle unit 20 by way of the energy flow. The vehicle drive mechanism 14 reduces the energy supplied and the energy transferred by the energy flow to the vehicle unit 20, in order to reduce the thermal loading of the vehicle unit 20 and thereby to cool it.

By way of an interface 101 the control unit 100 accesses a temperature model 30, which provides a temperature of the vehicle unit 20 to be cooled. In an embodiment, the said temperature is an operating temperature of the vehicle component 21. In an embodiment the operating temperature is determined on the basis of a temperature of the coolant, the coolant temperature being determined by a temperature sensor (not shown in the figures). According to a further embodiment the temperature model 30 is stored in the control unit 100.

Figure 2:
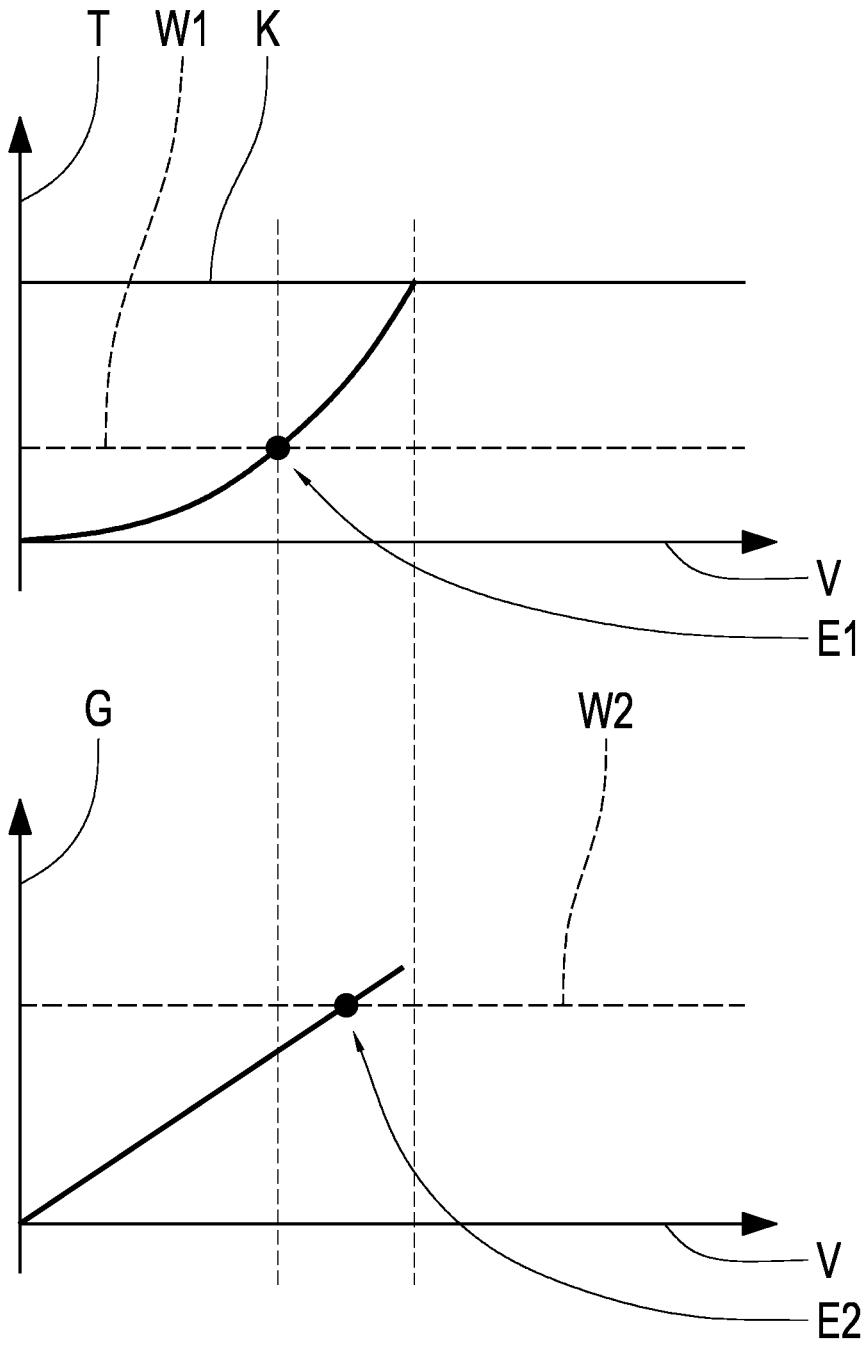
FIG. 2: shows diagrams illustrating the variation of a temperature and a temperature gradient, in order to explain the invention.

In FIG. 2, a first diagram shows the time variation of the temperature T. During the operation of the vehicle unit 20 the temperature T increases and exceeds a threshold value W1 for the temperature T. The threshold value W1 is stored in the control unit 100. The control unit 100 checks whether the temperature T is higher than the threshold value W1 and establishes, as a result of the check, that the temperature T has exceeded the threshold value W1. The threshold value W1 is a temperature value which is lower than a critical temperature K, at which the vehicle unit 20 reaches a condition critical for its operation. In the said operationally critical condition the vehicle unit 20 has to be cooled in order to avoid damage to the vehicle unit 20 caused by overheating. On the basis of the threshold value W1 the result E1 of the check is noted by the control unit 100 before the operationally critical condition is reached.

A second diagram in FIG. 2 shows the time variation V of a temperature gradient G, which is determined by the control unit 100 from the time variation V of the temperature T. During the operation of the vehicle unit 20 the temperature gradient G increases and exceeds a threshold value W2 for the temperature gradient G. If the control unit 100 has determined that the check result E1 exists, the control unit 100 checks whether the temperature gradient G exceeds the threshold value W2 and establishes as a further check result E2 that the temperature gradient G has exceeded the threshold value W2. On the basis of the threshold value W2 the further check result E2 is also determined by the control unit 100 before the operationally critical condition is reached. If both check results E1 and E2 confirm the stated condition, the control unit 100 actuates the vehicle device 10 in order to bring about the cooling of the vehicle unit 20.

Figure 3:
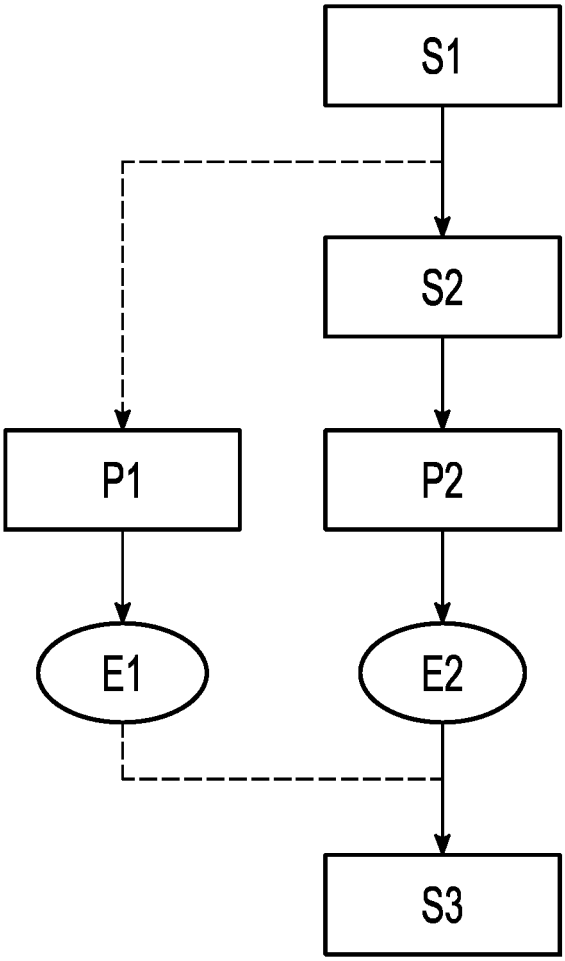
FIG. 3: shows a flow chart of a method for controlling a vehicle device, according to an embodiment of the invention.

FIG. 3 shows a flow chart of process steps in the form of a sequence diagram. By virtue of the process steps a method for controlling the vehicle device 10 for bringing about the cooling of the vehicle unit 20 is implemented. The process steps are carried out by the control unit 100, which controls the vehicle device 10 so as to cool the vehicle unit 20 in such manner that the temperature T does not exceed the critical temperature value K. According to an embodiment, the control unit 100 is designed to control the vehicle device 10 in such manner that the temperature T does not exceed the critical temperature value K.

In a step S1, by way of the interface 101 the control unit 100 reads out the model data from the temperature model 30 that pictures the temperature T and determines the temperature T. The control unit 100 comprises a computing system 110 which determines the temperature T. In an optional checking step P1 the computing system 110 checks whether the temperature T exceeds a threshold value W1 for the temperature T. If T exceeds W1, then the computing system 110 confirms the check result E1. In a further step S2 the computing system 110 determines the temperature gradient G from the time variation V of the temperature T. In a checking step P2 the computing system 110 checks whether the temperature gradient G exceeds the threshold value W2 for the temperature gradient G. If the temperature gradient G exceeds the said threshold value W2, the computing system 110 confirms the further check result E2.

In a further step S3, the control unit 100 emits a signal for controlling the vehicle device 10 in order to bring about the cooling of the vehicle component 21. The control unit 100 emits the signal if the further check result E2 is confirmed. In an embodiment, the control unit 100 emits the signal when both of the check results E1 and E2 are confirmed. If the vehicle device 10 comprises the cooling device 12 which activates the cooling system 2 in order to cool the vehicle unit 20, the signal to actuate the cooling device 12 is emitted, for example in order to increase a cooling volume of the coolant. If the vehicle device 10 comprises the vehicle drive mechanism 14 that supplies the energy which is transferred to the vehicle unit 20 by way of the energy flow, then the signal for actuating the vehicle drive mechanism 14 is emitted, for example in order to limit the energy flow.

INDEXES

2 Cooling system
4 Functional relationship
10 Vehicle device
12 Cooling device
14 Vehicle drive mechanism
20 Vehicle unit
21 Vehicle component
30 Temperature model
100 Control unit
110 Computing system
200 Vehicle
E1 Check result
E2 Check result
G Temperature gradient
K Critical temperature value
P1 Check of the read-in information
P2 Check of the temperature gradient
S1 Read-in of the information
S2 Determination of the temperature gradient
S3 Emission of the signal
T Temperature
V Time variation
W1 Threshold value
W2 Threshold value

The invention claimed is:

1. A method for controlling a vehicle device configured to bring about the cooling of a vehicle unit, the method comprising:

reading-in a temperature which is in functional relationship with an operation of the vehicle unit;

determining a gradient of the temperature;

checking whether the gradient exceeds a threshold value; and emitting a signal for controlling the vehicle drivetrain as a function of a check result of checking whether the gradient exceeds the threshold value, in order to bring about the cooling of the vehicle unit by limiting drivetrain torque and/or limiting a drivetrain rotation speed.

2. The method according to claim 1, comprising:

checking whether the temperature exceeds a threshold value;

wherein emitting the signal is carried out as a function of a check result of checking whether the temperature exceeds the threshold value.

3. The method according to claim 2, wherein checking whether the gradient exceeds the threshold value and/or checking whether the temperature exceeds the threshold value is performed in stages; and emitting the signal is performed as a function of a currently exceeded staged threshold value.

4. The method according to claim 1, wherein emitting the signal includes maintaining the temperature below a critical temperature value for the temperature of the vehicle unit.

5. The method according to claim 1, wherein the vehicle device comprises a cooling device for cooling the vehicle drivetrain, and emitting the signal for controlling the cooling device is emitted at least in part in order to bring about the cooling of the vehicle drivetrain by means of the cooling device.

6. The method according to claim 1, wherein emitting the signal for controlling the vehicle drivetrain reduces a torque of the vehicle drivetrain.

7. The method according to claim 1, wherein the vehicle drivetrain comprises a transmission.

8. The method according to claim 1, wherein the vehicle drivetrain comprises an energy source.

9. The method according to claim 1, comprising:

filtering the gradient, wherein checking whether the gradient exceeds a threshold value is carried out on the basis of a filtered temperature gradient.

10. A control unit for controlling a vehicle device configured to bring about the cooling of a vehicle drivetrain, the control unit comprising:

an interface for reading in a temperature which is in functional relationship with an operation of the vehicle drivetrain;

a computing system configured to determine a temperature gradient on the basis of the temperature read in, wherein the computing system is configured to check whether the temperature gradient exceeds a threshold value for the temperature gradient; and an interface for emitting a signal for the control of the vehicle device as a function of a check result of checking whether the temperature gradient exceeds the threshold value, in order to bring about the cooling of the vehicle drivetrain by one or more of limiting drivetrain torque and limiting a drivetrain rotation speed.

11. A vehicle comprising a vehicle device configured to bring about the cooling of a vehicle drivetrain, wherein the vehicle comprises the control unit for controlling the vehicle device in accordance with claim 10.

* * * * *